US006031515A

United States Patent [19]

Okamoto

[11] Patent Number: 6,031,515

[45] Date of Patent: Feb. 29, 2000

[54] DISPLAY DRIVER

[75] Inventor: Kohei Okamoto, Tokyo, Japan

[73] Assignee: NEC Corporation, Tokyo, Japan

[21] Appl. No.: 08/936,271

[22] Filed: Sep. 24, 1997

[30] Foreign Application Priority Data

Sep. 26, 1996 [JP] Japan ..... 8-254433

[51] Int. Cl.[7] ..... G09G 3/36

[52] U.S. Cl. ..... 345/100; 345/98; 345/89

[58] Field of Search ..... 345/98, 100, 89, 345/204, 205, 206, 208, 55; 327/416, 427, 434, 419

[56] References Cited

U.S. PATENT DOCUMENTS

| | | | |
|---|---|---|---|
| 3,936,676 | 2/1976 | Fujita . | |
| 5,229,761 | 7/1993 | Fuse | 345/99 |
| 5,262,881 | 11/1993 | Kuwata et al. | 345/100 |
| 5,387,828 | 2/1995 | Nakano | 326/68 |
| 5,404,081 | 4/1995 | Kane et al. | 315/169.1 |
| 5,489,919 | 2/1996 | Kuwata et al. | 345/100 |
| 5,548,302 | 8/1996 | Kuwata et al. | 345/89 |
| 5,596,344 | 1/1997 | Kuwata et al. | 345/103 |
| 5,682,177 | 10/1997 | Kuwata et al. | 345/100 |
| 5,818,406 | 10/1998 | Tsuchi et al. | 345/89 |

FOREIGN PATENT DOCUMENTS 0 344 323 12/1989 European Pat. Off. .

OTHER PUBLICATIONS

T.N. Ruckmongathan, International Display Research Conference, IEEE, 1988 pp. 80–85.

*Primary Examiner*—Richard A. Hjerpe
*Assistant Examiner*—Marthe Y. Marc-Coleman
*Attorney, Agent, or Firm*—Scully, Scott Murphy & Presser

[57] ABSTRACT

A display driver which is simplified in construction of a power supply circuit and is reduced in power dissipation. The display driver includes a column driver including a decoder and a plurality of analog switches. One of the analog switches which outputs a voltage of the lowest potential is formed from an nMOS field effect transistor connected between a potential supply point of the lowest potential to be outputted and an output point so as to form a current path. The back gate electrode of the MOS field effect transistor is connected to the potential supply point of the lowest potential. A level shift circuit level shifts a lower side potential from among output signals of the decoder to the lowest potential to be outputted and provides the level shifted signal to the gate electrode of the MOS field effect transistor. Since the lowest potential to be supplied to the display elements belonging to a column need not necessarily be fixed to the ground potential, the construction of the power supply circuit can be simplified and reduction in current of the power supply circuit and reduction in number of circuit components can be achieved.

3 Claims, 8 Drawing Sheets

DISPLAY DRIVER

BACKGROUND OF THE INVENTION

1. Field of the Invention

This invention relates to a display driver such as, for example, a liquid crystal display (LCD) driver.

2. Description of the Related Art

Various display drivers are known, and a system construction of an exemplary one of conventional LCD drivers is shown in block diagram in FIG. 4.

LCD drivers are generally divided into two types including a driver which employs an IAPT (Improved Alt and Pleshko Technique) which is used popularly and an LCD driver which employs an IHAT (Improved Hybrid Addressing Technique) disclosed, for example, in Proceeding of the SID, Vol. 24/3, p.259 or in Collection of Drafts for the 1988 International Display Research Conference, IEEE, p.80.

Referring to FIG. 4, where the LCD driver shown is of the type which is based on the IAPT, a row driver 2 outputs a selection for each one line, and data corresponding to the selected line is outputted from a column driver 3. Where the IAPT is employed, the column driver and the row driver are both required to have a high voltage withstanding property, for example, against approximately 20 V.

On the other hand, where the LCD driver shown in FIG. 4 is of the type which is based on the IHAT, the row driver 2 outputs a selection signal for each plurality of lines, for example, for each two lines. This allows the column driver to have a voltage withstanding property against, for example, approximately 5 V (the row driver is required to have a voltage withstanding property against approximately 35 V). Where the IHAT is employed, since the column driver can be realized with a process of a 5 V system, a control circuit, a display RAM (random access memory) and some other circuits, which are normally provided externally of such column driver where the IAPT is employed, can be built in the column driver. In the circuit of FIG. 4, a control circuit in the column driver 3 (master chip) controls a column driver 4 (slave chip) and the row driver 2 with control signals. Meanwhile, display data from a CPU (not shown) are directly stored into display RAMs in the column drivers 3 and 4.

The LCD driver shown in FIG. 4 requires a large number of voltages as illustrated in FIG. 5. Referring to FIG. 5, for the column drivers 3 and 4, a logic ground potential GND and a logic power supply voltage $V_{CC2}$ are used for a logic system for a CPU interface (I/F). Meanwhile, for an LCD driving system, an LCD driving voltage $V_0$, another LCD driving voltage $V_1$, a further LCD driving voltage $V_2$ and an LCD driving power supply voltage $V_{CC1}$ are required. Here, the logic ground potential GND and the LCD driving power supply voltage $V_{CC1}$ are used also as outputs of control signals to the row driver 2. Meanwhile, for the row driver 2, the logic ground potential GND and the LCD driving power supply voltage $V_{CC1}$ are used for a logic system for an interface of a control signal from the column driver 3. On the other hand, an LCD driving voltage $V_{SS}$, the LCD driving voltage $V_1$ and an LCD driving voltage $V_{DD}$ are required for the LCD driving system.

Subsequently, a driving method for the LCD is described. The row driver 2 outputs the LCD driving voltage $V_1$ for non-selection, but outputs LCD driving voltage $V_{DD}$ or LCD driving voltage $V_{SS}$ for selection. Whether the voltage $V_{DD}$ should be outputted or the voltage $V_{SS}$ should be outputted for selection is based on a predetermined pattern. This pattern is incorporated in the control circuit in the column driver and is transmitted to the row driver using a control signal.

Meanwhile, each of the column drivers performs calculation based on the display data and the output pattern of the row driver, and selects and outputs one of the voltages $V_0$, $V_1$ and $V_2$ in accordance with a result of the calculation. An output switch section is included in the column driver and performs such selection of an output voltage. An equivalent circuit of an example of the output switch section is shown in FIG. 6. Referring to FIG. 6, the output switch section includes a decoder circuit 6 for decoding a signal from a logic circuit in the column driver, and analog switches 7A, 7B and 7C which are opened or closed in response to output signals of the decoder circuit 6. In order to realize the circuit shown in FIG. 6 with an integrated circuit, each of the analog switches 7A, 7B and 7C is formed from such a p-channel MOS transistor (pMOS transistor) $Q_{P1}$ and an n-channel MOS transistor (nMOS transistor) $Q_{N1}$ connected in parallel as shown in FIG. 7. The back gate electrode (an electrode communicated with a region of a MOS transistor in which a channel is formed such as, for example, a silicon crystal substrate or a well formed in such substrate) of the pMOS transistor $Q_{P1}$ is connected to the LCD driving power supply voltage $V_{CC1}$. Meanwhile, the back gate electrode of the nMOS transistor $Q_{N1}$ is connected to the logic ground potential GND. A signal C from the decoder circuit is inputted in non-reversed and reversed states to the gate electrodes of the two MOS transistors $Q_{P1}$ and $Q_{N1}$. Accordingly, the two MOS transistors $Q_{P1}$ and $Q_{N1}$ exhibit a same conduction state such that they both exhibit an on state or an off state in response to the signal C to connect or disconnect an input point IN (to which the voltage $V_0$, $V_1$ or $V_2$ is supplied) and an output point OUT to or from each other.

In the conventional LCD driver described above, the logic ground potential GND for the column driver and the LCD driving voltage $V_0$ for the column driver must have the relationship of $GND \leqq V_0$ without fail. This is described below.

It is first assumed that, of the output switch section of the column driver shown in FIG. 6, the analog switch 7C is at the potential $V_0$ lower than the logic ground potential GND. In this instance, the potential $V_0$ at the input point IN of the analog switch shown in FIG. 7 is lower than then the logic ground potential GND. In particular, in the nMOS transistor $Q_{N1}$ in FIG. 7, the potential at an n+ region (a source region or a drain region) (which connects to the input point IN) exhibits a lower potential than a p region (channel region) which is at the ground potential GND. As a result, there is the possibility that a pn junction between the channel region and the input point IN may be biased in a forward direction and current may flow in a direction from the ground toward the input point IN, resulting in incomplete operation, deterioration in performance or destruction of the IC. If, as a countermeasure against this, the ground potential GND of the column driver is set to a negative potential together with the LCD driving voltage $V_0$, then this results in incoincidence in level at the CPU interface I/F and makes transfer of display data impossible. Consequently, the potential $V_0$ must be kept higher than the logic ground potential GND without fail.

Further, in order to adjust the contrast of the LCD, the potential differences of the potentials $V_0$, $V_2$, $V_{DD}$ and $V_{SS}$ from the voltage $V_1$ are varied. Here, if the potential $V_0$ is set variable, then there is the possibility that, depending upon the adjustment of the contrast, the potential $V_0$ may become lower than the ground potential GND. Accordingly, an LCD driving power supply circuit 1 is required to keep the potential $V_0$ to the ground potential GND as seen in FIG. 8. On the other hand, for the level power supply to the LCD, a tolerance of ±several mV is required. Therefore, if the potential $V_0$ is fixed to the ground potential GND, then a high degree of accuracy is required for the absolute value of each of the potentials $V_1$, $V_2$, $V_{DD}$ and $V_{EE}$ with respect to the logic ground potential GND. However, it is usually difficult to require the tolerance of ±several mV for a DC/DC converter. Consequently, outputs of a DC-DC converter 8 cannot be used directly as the potentials $V_{DD}$ and $V_{SS}$, and buffer amplifiers 9A and 9B, a reference circuit 10 for adjusting the potentials $V_{DD}$ and $V_{SS}$ and so forth are required. As a result, there is a problem in that not only the number of parts of the power supply circuit increases but also the current consumption of the power supply circuit increases.

SUMMARY OF THE INVENTION

It is an object of the present invention to provide a display driver such as, for example, an LCD driver which eliminates the limitation of $GND \leqq V_0$ so that a buffer amplifier and a reference circuit can be eliminated from a power supply circuit thereby to allow reduction in power dissipation and simplification in circuit and apparatus construction.

In order to attain the object described above, according to the present invention, there is provided a display driver for a display unit which includes a plurality of display elements arranged in a matrix of rows and columns, comprising a column driver for switchably outputting one of a plurality of voltages to the display elements on one of the columns, the column driver including a decoder and a plurality of analog switches each formed from a semiconductor switch and controlled to be opened or closed by an output signal of the decoder, one of the analog switches which outputs a voltage of the lowest potential being formed from a MOS field effect transistor connected between a potential supply point of the lowest potential to be outputted and an output point so as to form a current path, the MOS field effect transistor having a back gate electrode connected to the potential supply point of the lowest potential, and a level shift circuit for level shifting a lower side potential from among the output signals of the decoder to the lowest potential to be outputted and providing the level shifted signal to a gate electrode of the MOS field effect transistor.

In the display driver, the switch for selecting the lowest potential in the column driver is formed not from such an analog switch as is employed in the conventional LCD driver described hereinabove (refer to FIGS. 4 and 7) but from a MOS field effect transistor. The MOS field effect transistor is connected to the potential supply point of the lowest potential to be outputted not only, for example, at the source electrode thereof but also at the back gate thereof. Further, the level shift circuit is interposed between the MOS field effect transistor and the decoder so that the lower side potential to the MOS field effect transistor is level shifted to the lowest potential.

Consequently, even if a potential lower than a ground potential is applied as the lowest potential, forward current toward the potential supply point of the lowest potential does not flow through a diode connected between the back gate electrode and the source electrode of the MOS transistor. In other words, the lowest potential ($V_0$) can be set to a potential lower than the ground potential (GND) and need not be fixed to the ground potential. Consequently, the other potentials ($V_{DD}$ and $V_{SS}$) need not have absolutely high degrees of accuracy with respect to the ground potential.

Accordingly, with the display driver, the lowest potential to be supplied to the display elements belonging to a column need not necessarily be fixed to the ground potential. Consequently, the construction of the power supply circuit can be simplified and reduction in current of the power supply circuit and reduction in number of circuit components can be achieved.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENT

Figure 1:
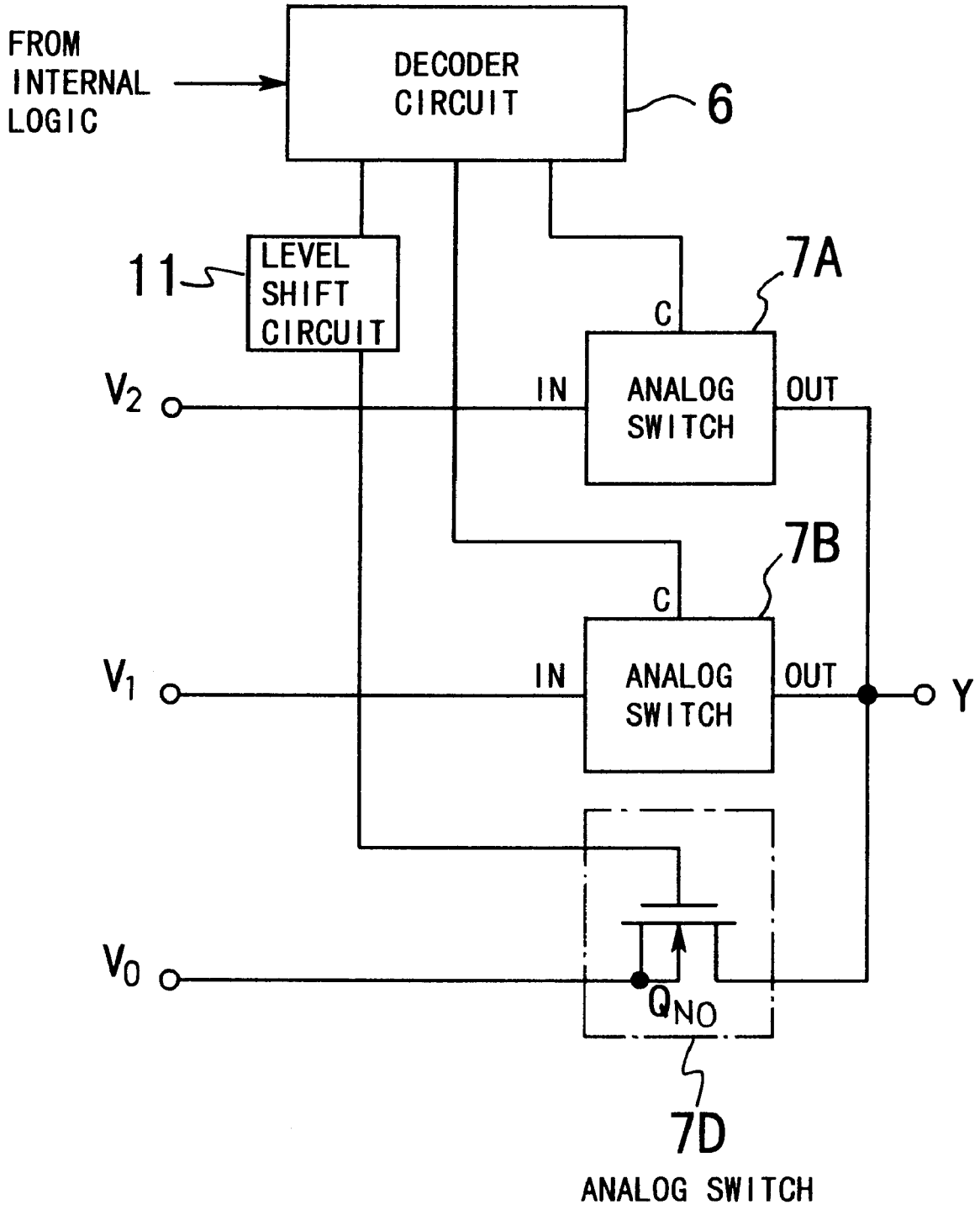
FIG. 1 is an equivalent circuit diagram of an output switch section of a column driver of a display driver to which the present invention is applied.
Figure 4:
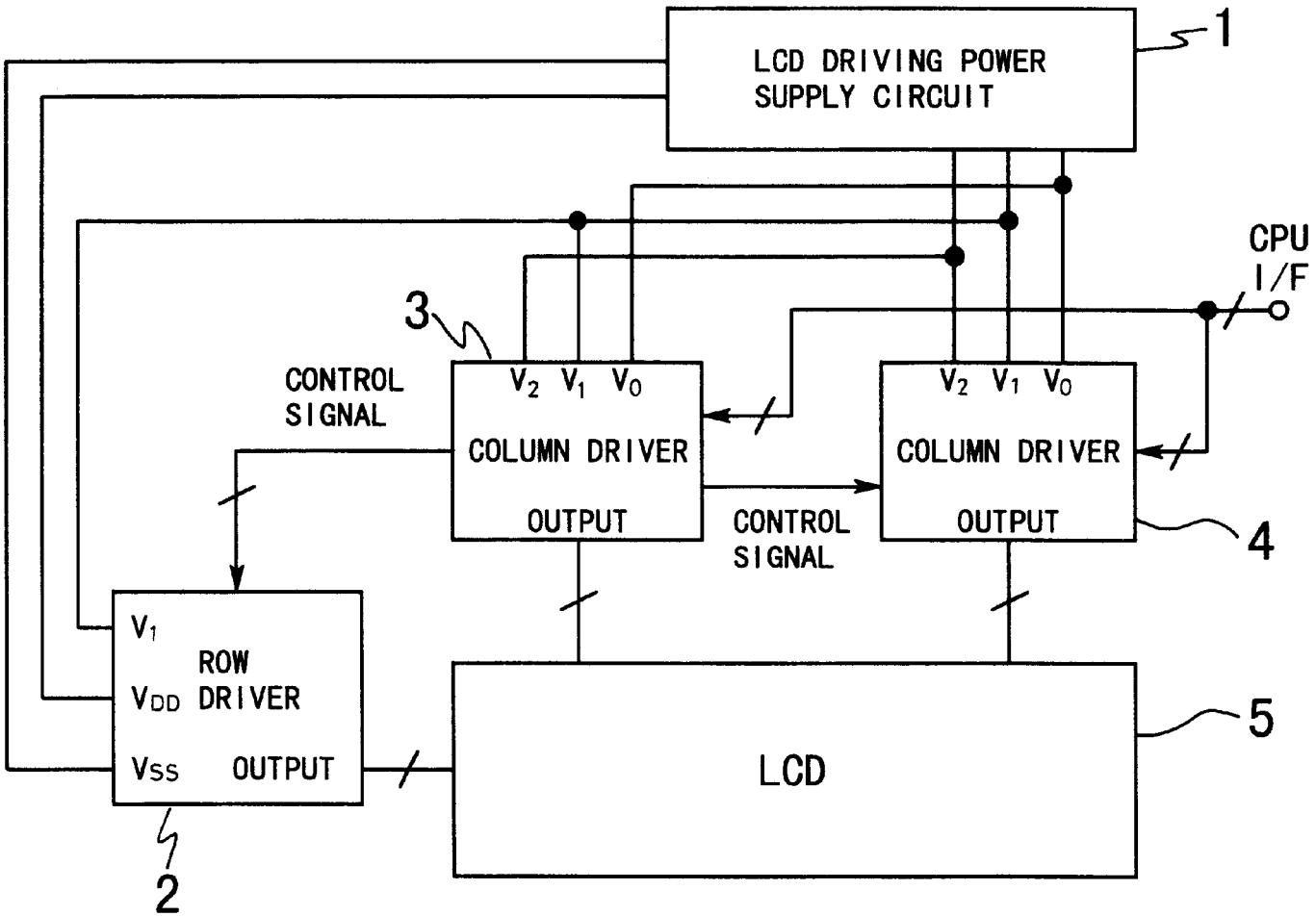
FIG. 4 PRIOR ART
FIG. 4 is a block diagram showing a system construction of an LCD driver.
Figure 5:
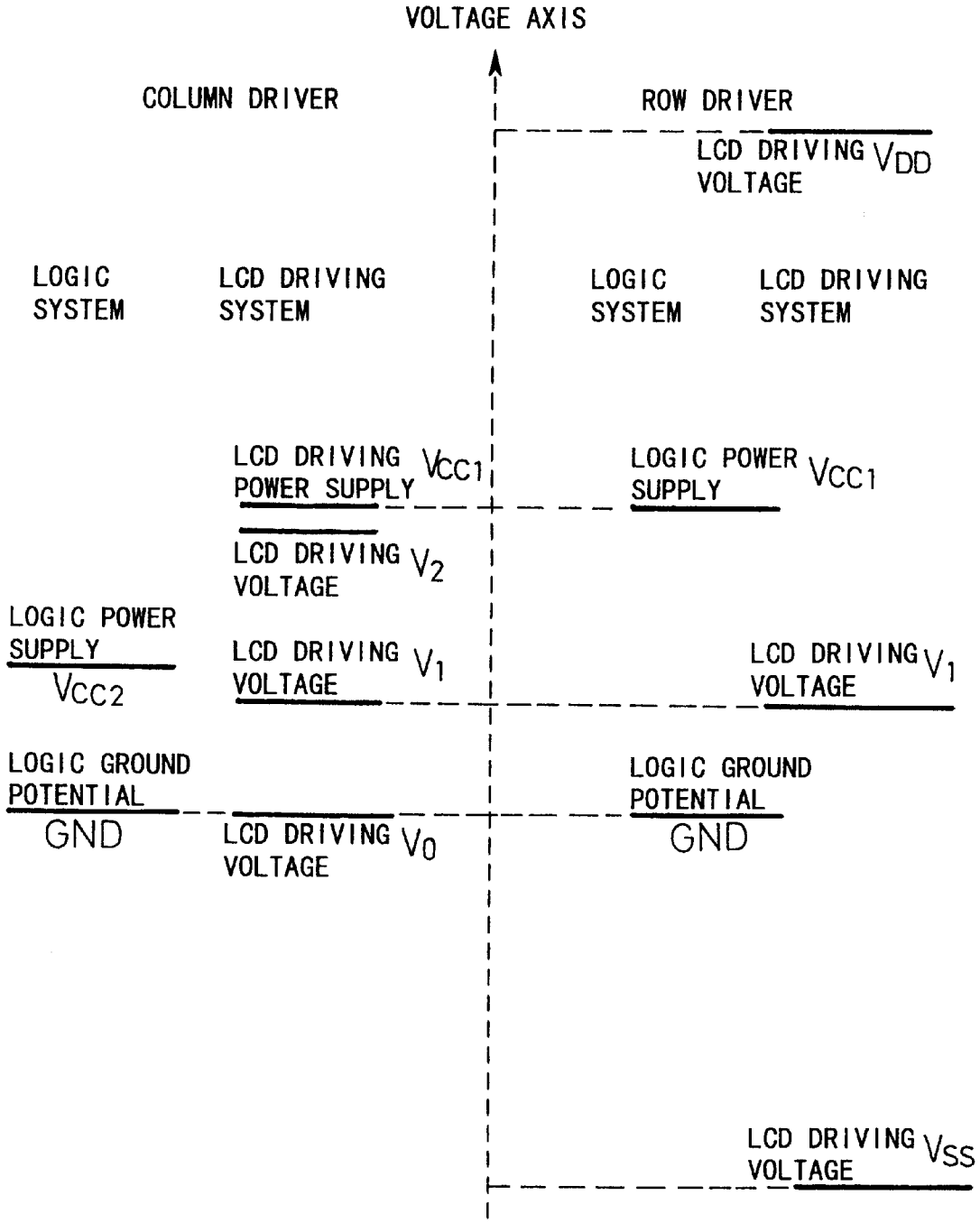
FIG. 5 PRIOR ART
FIG. 5 is a diagrammatic view illustrating different voltages used in a conventional LCD driver.
Figure 6:
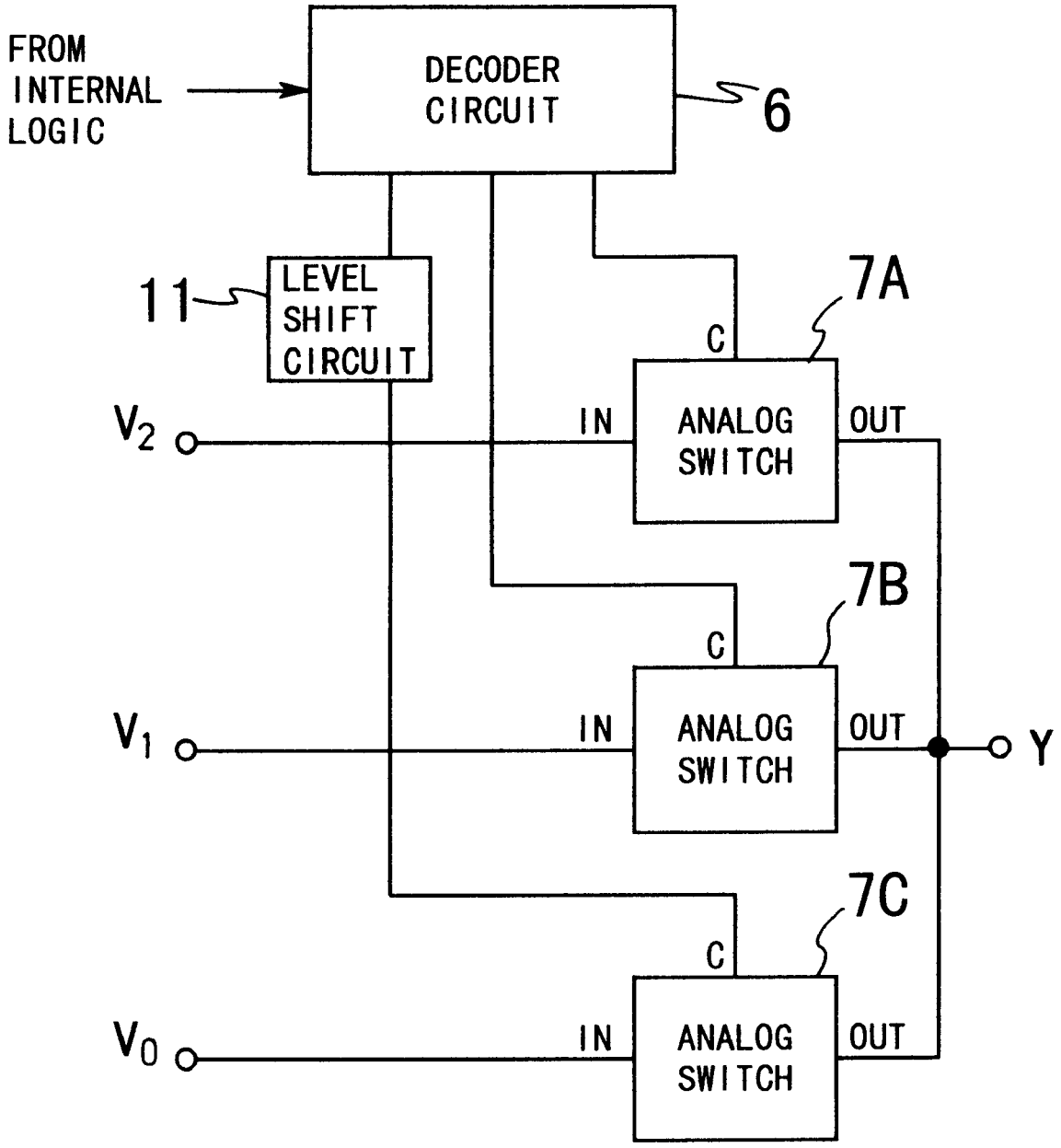
FIG. 6 PRIOR ART
FIG. 6 is an equivalent circuit diagram of an output switch section of a conventional column driver.
Figure 7:
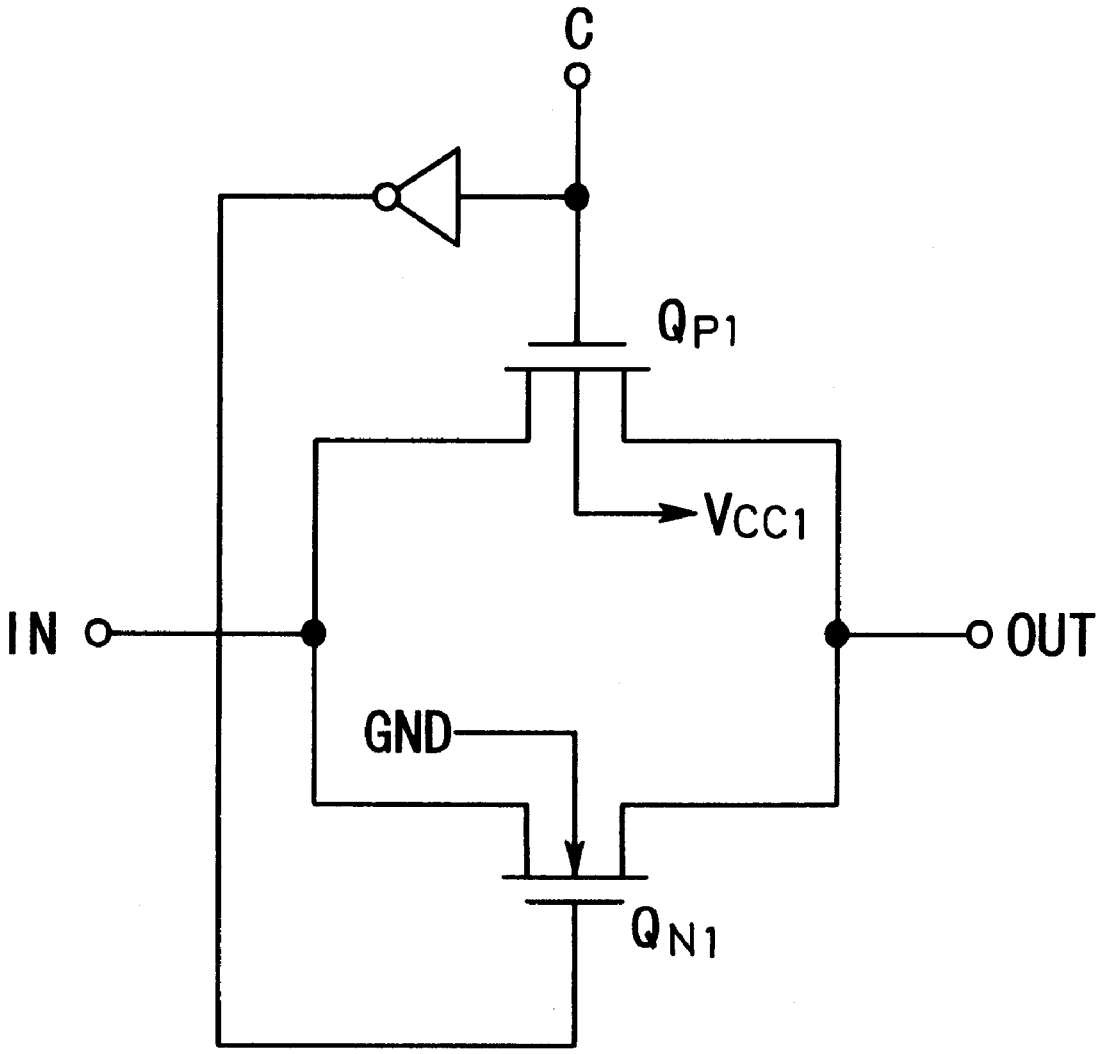
FIG. 7 PRIOR ART
FIG. 7 is a circuit diagram of an analog switch employed in the output switch section shown in FIG. 6.

A display driver to which the present invention is applied is described below with reference to the accompanying drawings. The display driver is applied as an LCD driver which has a generally similar system construction to that of the conventional LCD driver described with reference to FIG. 4. However, the LCD driver in the present embodiment is different from the conventional LCD driver in construction of the column drivers 3 and 4. An equivalent circuit of the output switch section of the column drivers 3 and 4 is shown in FIG. 1. More particularly, referring to FIG. 1, the LCD driver of the present embodiment is different from the conventional LCD driver in that an nMOS transistor $Q_{N0}$ is used for the selection circuit of the potential $V_0$ and that an output signal of the decoder circuit 6 is inputted to the gate electrode of the nMOS transistor $Q_{N0}$ through a level shift circuit 11.

The nMOS transistor $Q_{N0}$ is connected at the drain electrode thereof to an output point Y, at the source electrode and the back gate electrode thereof to an input point (potential $V_0$) and at the gate electrode thereof to the level shift circuit 11. The level shift circuit 11 converts the amplitude $V_{CC1}$–GND of an output signal of the decoder circuit 6 into and outputs an amplitude $V_{CC1}$–$V_0$.

Figure 2:
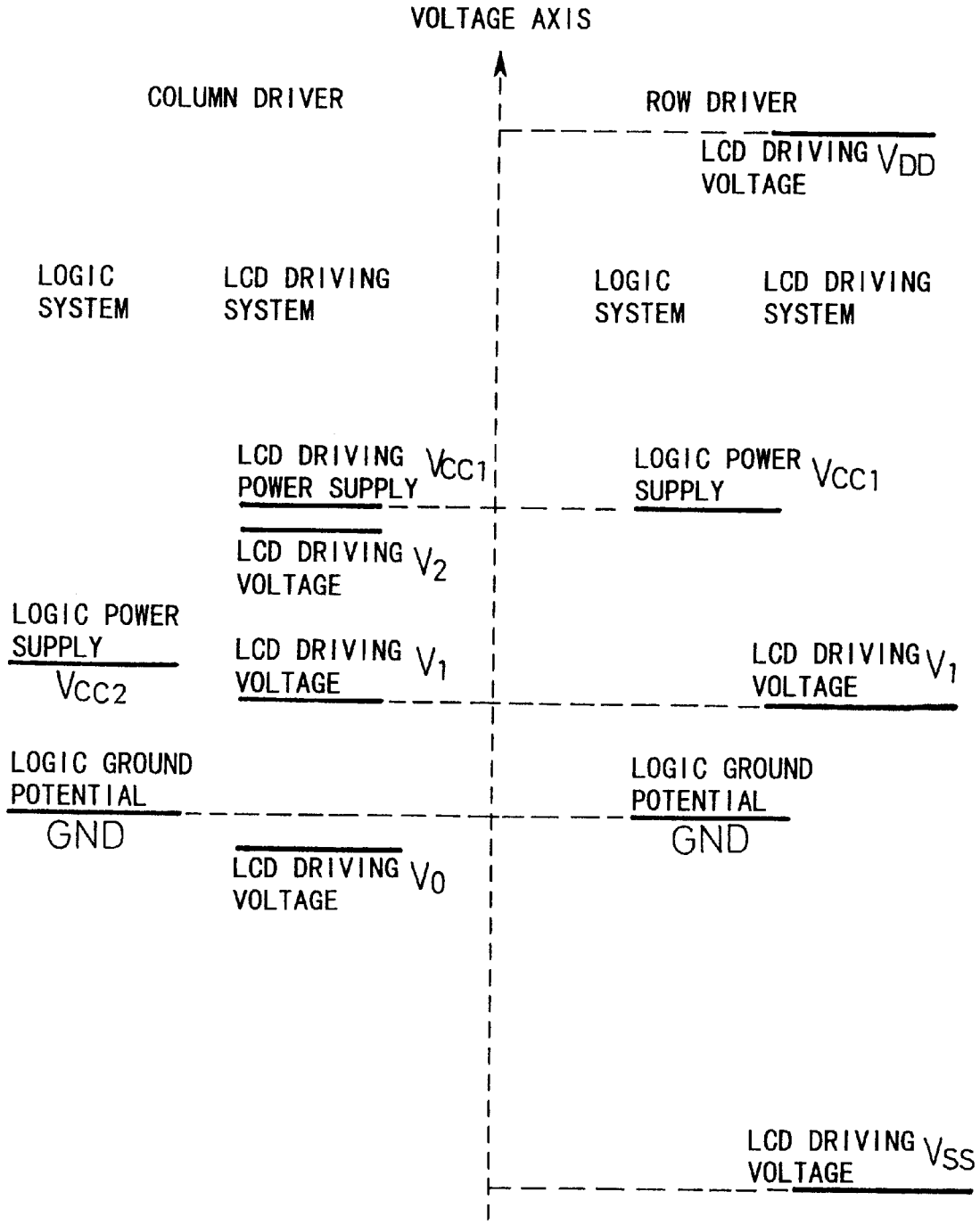
FIG. 2 is a diagrammatic view illustrating various voltages used in the display driver.

Voltages in the LCD driver in the present embodiment are illustrated in FIG. 2. The logic system of each of the column drivers operates with the logic ground potential GND and the logic power supply voltage $V_{CC2}$ similarly as in the conventional LCD driver. In the LCD driving system, while the LCD driving voltage $V_1$, the LCD driving voltage $V_2$ and the LCD driving power supply voltage $V_{CC1}$ are similar to those of the conventional LCD driver, the LCD driving voltage $V_0$ need not be set to a level equal to that of the logic ground potential GND and may be higher or lower than the logic ground potential GND.

For outputs of control signals to the row driver, the LCD driving power supply voltage $V_{CC1}$ and the logic ground potential GND are used. The voltages regarding the row driver are same as those of the conventional LCD driver.

Figure 3:
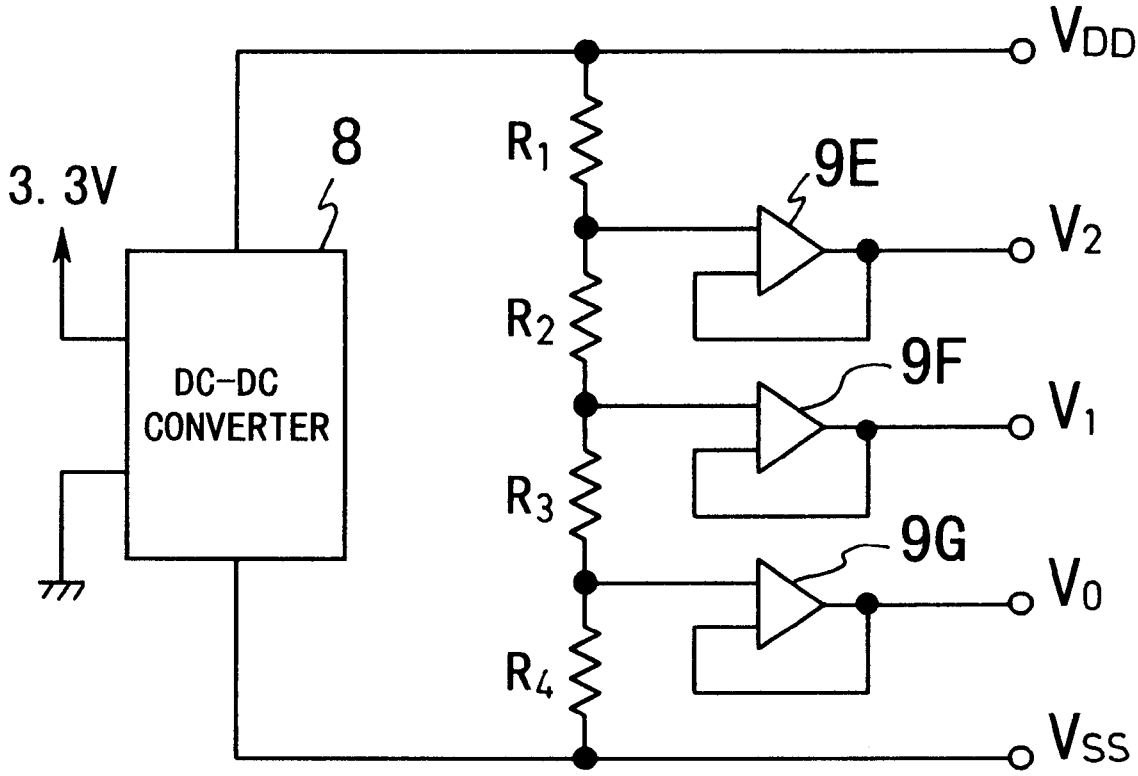
FIG. 3 is a circuit diagram of an LCD driving power supply circuit of the display driver.

In the present embodiment, the potential $V_0$ need not be fixed to the ground potential GND, and consequently, the potentials $V_{DD}$ and $V_{SS}$ need not have high degrees of absolute accuracy with respect to the ground potential GND. Accordingly, the construction of the LCD driving power supply circuit 1 can be simplified as seen in FIG. 3, and reduction in current of the power supply circuit and reduction in number of circuit parts can be achieved.

Figure 8:
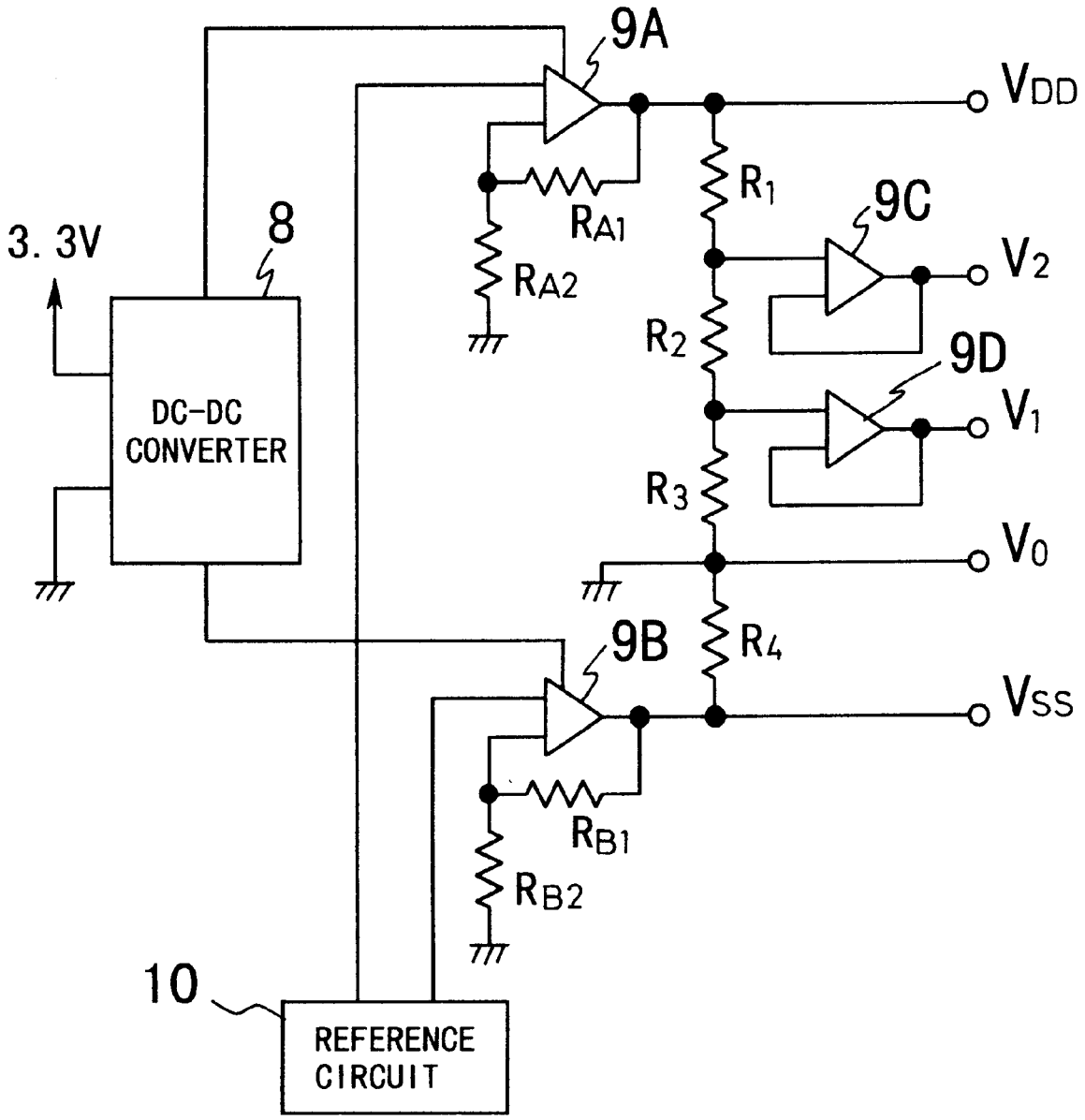
FIG. 8 PRIOR ART
FIG. 8 is a circuit diagram of a conventional LCD driving power supply circuit.

In the present embodiment, the outputs of the DC-DC converter 8 are used as they are as the potentials $V_{DD}$ and $V_{SS}$, and the levels of the potentials $V_0$, $V_1$ and $V_2$ are realized by resistive potential division of the difference between the potentials $V_{DD}$ and $V_{SS}$. The degrees of accuracy of the individual levels depend upon the degrees of relative accuracy of the resistors $R_1$, . . . , and $R_4$. Comparison between the power supply circuit in the present embodiment shown in FIG. 3 and the conventional LCD driving power supply circuit described hereinabove with reference to FIG. 8 reveals that the two buffer amplifiers 9A and 9B, the reference circuit 10 and the four resistors $R_{A1}$, $R_{A2}$, $R_{B1}$ and $R_{B2}$ are omitted in the power supply circuit in the present embodiment. On the other hand, the power supply circuit in the present embodiment additionally includes a buffer amplifier 9G. While a power supply voltage near to the LCD driving voltage $V_{DD}$ is used for the buffer amplifiers in the conventional power supply circuit, the buffer amplifier 9G in the present embodiment is used with the power supply voltage of $V_{CC1}$. Consequently, power supply current for one buffer amplifier can be eliminated.

Consequently, the circuit construction and the circuit current for one buffer amplifier, one reference circuit and four resistors can be reduced comparing with those of the conventional LCD driver.

Having now fully described the invention, it will be apparent to one of ordinary skill in the art that many changes and modifications can be made thereto without departing from the spirit and scope of the invention as set forth herein.

What is claimed is:

1. A display driver for a display unit which includes a plurality of display elements arranged in a matrix of rows and columns, comprising:

a column driver for switchably outputting one of a plurality of voltages to the display elements on one of the columns, said column driver including a decoder and a plurality of analog switches, each analog switch being formed from a semiconductor switch and controlled to be opened or closed by an output signal of said decoder;

one of said analog switches which outputs a voltage of the lowest potential being formed from a MOS field effect transistor connected between a potential supply point of the lowest potential to be outputted and an output point so as to form a current path;

said MOS field effect transistor having a back gate electrode connected to the potential supply point of the lowest potential; and a level shift circuit for level shifting a lower side potential from among the output signals of said decoder to the lowest potential to be outputted and providing the level shifted signal to a gate electrode of said MOS field effect transistor.

2. A display driver as claimed in claim 1, wherein the drain electrode of the MOS field effect transistor is connected to the output point, and the source electrode and the back gate electrode are connected to the potential supply point of the lowest potential $V_0$.

3. A display driver as claimed in claim 2, wherein the level shift circuit converts the amplitude of a display driver power supply voltage $V_{CC1}$–GND (ground) of an output signal of the decoder circuit into and outputs an amplitude voltage $V_{CC1}$–$V_0$.

* * * * *